US009482212B1

(12) United States Patent
Bethke

(10) Patent No.: US 9,482,212 B1
(45) Date of Patent: Nov. 1, 2016

(54) HOLDDOWN SYSTEM FOR AN AXIAL PISTON PUMP

(71) Applicant: Hartmann Controls, Inc., Hartland, WI (US)

(72) Inventor: Donald G. Bethke, Bonita Springs, FL (US)

(73) Assignee: Hartmann Controls, Inc., Hartland, WI (US)

( * ) Notice: Subject to any disclaimer, the term of this patent is extended or adjusted under 35 U.S.C. 154(b) by 283 days.

(21) Appl. No.: 14/096,648

(22) Filed: Dec. 4, 2013

Related U.S. Application Data

(60) Provisional application No. 61/735,284, filed on Dec. 10, 2012.

(51) Int. Cl.
*F04B 1/20* (2006.01)
*F04B 1/12* (2006.01)
*F04B 39/00* (2006.01)

(52) U.S. Cl.
CPC ..... *F04B 1/2007* (2013.01); *F04B 1/126* (2013.01); *F04B 1/2078* (2013.01); *F04B 1/20* (2013.01); *F04B 39/0027* (2013.01)

(58) Field of Classification Search
CPC ..... F04B 1/20; F04B 1/2007; F04B 1/2078; F04B 1/126; F04B 27/1063; F04B 27/18; F04B 39/0027; F15B 11/0426
USPC ..... 92/13, 71; 417/222.1, 269; 91/488, 499
See application file for complete search history.

(56) References Cited

U.S. PATENT DOCUMENTS 3,641,829 A * 2/1972 Reynolds ..... F04B 1/126 74/60
3,996,841 A * 12/1976 Gostomski, Jr. ..... F04B 1/2078 91/499
5,252,032 A * 10/1993 Iwanami ..... F04B 27/18 417/222.1
5,520,088 A * 5/1996 Dixen ..... F04B 1/126 91/499
5,794,515 A 8/1998 Bethke
5,813,314 A * 9/1998 Michiyuki ..... F04B 27/1063 417/269
5,937,646 A * 8/1999 Zakula ..... F15B 11/0426 60/430
7,546,797 B2 * 6/2009 Betz ..... F04B 1/126 92/57
8,721,304 B2 * 5/2014 Inagaki ..... F04B 39/0027 384/611

OTHER PUBLICATIONS

Brochure for Mannesmann RexRoth Variable Displacement Pump A10VO, 2 pages.

* cited by examiner

*Primary Examiner* — Devon Kramer
*Assistant Examiner* — Connor Tremarche
(74) *Attorney, Agent, or Firm* — Andrus Intellectual Property Law, LLP

(57) ABSTRACT

An axial piston pump includes a housing with a cover plate assembly, a rotor with reciprocable pistons rotatably mounted with a drive shaft and a swashplate assembly tiltably mounted relative to the drive shaft and engaged with outer ends of the pistons. A holddown spring is incorporated within the swashplate assembly and positioned outside the rotor such that the holddown spring tilts with the swashplate assembly and does not rotate with the drive shaft. The holddown spring applies a force holding the piston outer ends against the swashplate assembly and the rotor against the cover plate assembly.

11 Claims, 5 Drawing Sheets

HOLDDOWN SYSTEM FOR AN AXIAL PISTON PUMP

CROSS-REFERENCE TO RELATED APPLICATION

This application relates to and claims priority based on U.S. Provisional Patent Application Ser. No. 61/735,284 filed Dec. 10, 2012.

BACKGROUND OF THE INVENTION

The present disclosure relates generally to an axial piston pump and, more particularly, pertains to a pump having an improved holddown system which provides for proper loading of the pump components, and enables a smoother, quieter and more balanced pump operation.

Axial piston pumps are old and well known in the art. All such pumps include a swashplate (thrust plate) against which axial piston ends of piston assemblies bear, and along which such ends rotate with an angled reaction surface of the swashplate allowing a cyclic reciprocal movement of the pistons in the piston assemblies providing each piston-holding cylinder with low pressure intake and high pressure discharge of hydraulic fluid on each rotation. The swashplate (thrust plate) is mounted for rotation on a tilt axis transverse to a longitudinal axis of a drive shaft which drives a cylindrical rotor housing the pistons. Axial piston pumps rely on different designs or holddown systems for holding a rear end of the rotor against the valve plate and/or port end cover connected to a pump housing, and maintaining slipper shoes on the piston ends against the swashplate (thrust plate).

One traditional piston pump design incorporates a compression (holddown) spring inside the rotor, and utilizes transfer rods or pins (typically a set of three) to transmit the compression spring force to a spherical ring. The spherical ring engages a holddown plate that maintains the piston assemblies against the swashplate (thrust plate), and the rotor against the valve plate and the port end cover forming an action/reaction arrangement. The holddown spring, rods, spherical ring and holddown plate all rotate with the drive shaft, rotor and piston assemblies.

Another piston pump design employs a piston (holddown) spring inside of each piston assembly to hold the rotor against the valve plate, and each piston assembly against the swashplate (thrust plate). Again, the holddown springs rotate with the drive shaft, rotor and the piston assemblies.

In optimizing axial piston pump performance, it is critical to keep the rotor balanced for smooth and quiet pump operation. Unfortunately, it has been found that these previous pump designs require more than a desired amount of rotating parts which, when connected towards the rear of the pump outside the swashplate, cause rotor imbalance and weight problems that can negatively affect pump performance.

Therefore, it is desirable to provide a holddown system for an axial piston pump which loads the pump components in a manner which will keep the rotor balanced and ensures smooth, quiet operation of the pump. It is also desirable to provide an axial piston pump which reduces the number of pump components and simplifies pump manufacture and assembly.

SUMMARY OF THE INVENTION

The present disclosure relates to an axial piston pump including a housing having an outer wall defining an interior with an end wall at one end of the housing, and a cover plate assembly at an opposite end of the housing. A drive shaft extends through the end wall of the housing and is rotatably mounted on a longitudinal drive shaft axis passing through the housing. A rotor is attached to the drive shaft for rotation therewith, and a plurality of cylinders is formed in the rotor and provided with axially reciprocable pistons disposed in the cylinders. A swashplate assembly surrounds the drive shaft and is mounted in the housing for tilting movement on a tilt axis transverse to the drive shaft axis. A reaction surface of the swashplate assembly is engaged by outer ends of the pistons. A control arrangement is provided for tilting the swashplate assembly on the tilt axis to maintain the reaction surface angularly disposed with respect to the drive shaft axis. A holddown spring is incorporated within the swashplate assembly and positioned outside the rotor such that the holddown spring tilts with the swashplate assembly and does not rotate with the drive shaft. The holddown spring applies a continuous force holding the outer ends of the pistons against the swashplate assembly and the rotor against the cover plate assembly.

In the axial piston pump, a spherical load transfer ring is mounted for rotation with the drive shaft. A holddown plate surrounds the drive shaft and is engageable with the spherical load transfer ring. The pistons have piston shoes which pass through holes formed in the holddown plate. The swashplate assembly includes a thrust plate mounted to a swashplate. The reaction surface lies on a rear face of the thrust plate. The swashplate has a dished interior across which the thrust plate extends. The control arrangement includes a pressure compensating control piston and a volume control piston which are engaged with outer portions of the swashplate assembly. The tilt axis of the swashplate assembly is positioned at a rear side of the piston shoes so that there is no relative motion between the piston shoes and the holddown plate. One side of the holddown spring engages a bottom wall of the swashplate, and an opposite side of the holddown spring engages a front face of the thrust plate. The thrust plate is maintained within the dished interior of the swashplate. The holddown spring may take the form of a wave spring, a conical spring or a compression spring.

The present disclosure further relates to an axial piston pump having a drive shaft rotatably mounted in a housing provided with a cover plate assembly, a rotor attached to the drive shaft for rotation therewith, a plurality of cylinders formed in the rotor and provided with reciprocable pistons disposed in the cylinders and a swashplate assembly surrounding the drive shaft and mounted in the housing for tilting movement about a tilt axis. A holddown system includes a holddown spring incorporated within the swashplate assembly at a front portion of the pump and positioned outside the rotors such that the holddown spring tilts with the swashplate assembly and does not rotate with the drive shaft. The holddown spring applies a continuous force holding the pistons against the swashplate assembly and the rotor against the cover plate assembly.

BRIEF DESCRIPTION OF THE DRAWINGS

The drawings illustrate the best mode presently contemplated of carrying out the disclosure. In the drawings.

DETAILED DESCRIPTION OF THE INVENTION

Figure 1:
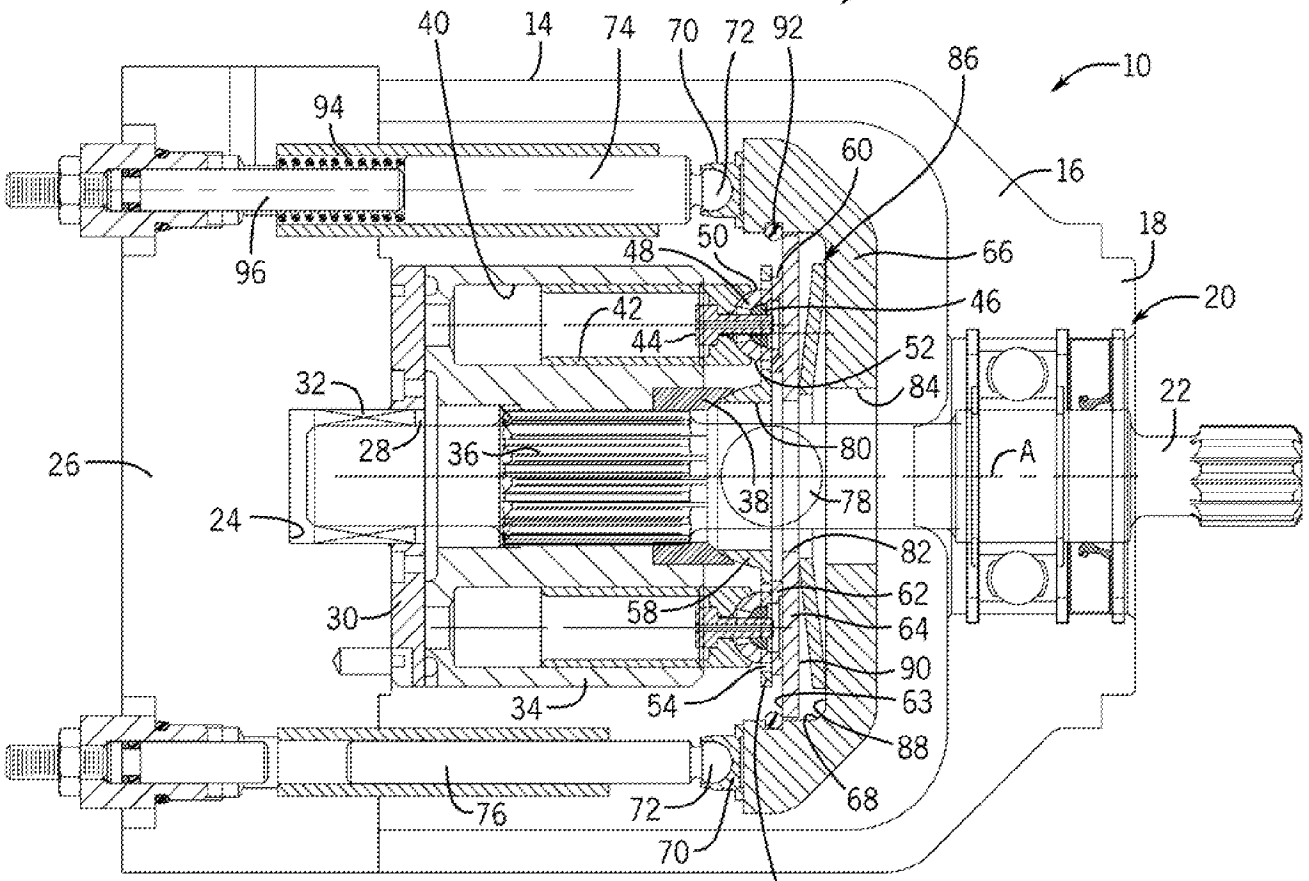
FIG. 1 is a vertical sectional view through an axial piston pump illustrating a holddown system of the present disclosure equipped with one type of holddown spring and shown with the swashplate at a neutral or zero position.

Referring now to the drawings, thereshown is an axial piston pump 10 including a housing 12 having an outer wall 14 and an integral end wall 16. The end wall 16 has an axially disposed hub 18 which is bored to include a roller bearing assembly 20 to rotatably support one end of a drive shaft 22. The one end of the drive shaft 22 extends outside the housing 12 and wall 16, and is typically provided with a pulley, coupling or direct drive for receiving a drive belt or drive shaft from a suitable source of motive power, such as an electric motor. The opposite end of the drive shaft 22 is rotatably supported in a counterbore 24 of a port end cover 26 attached to the housing 12. The opposite end of the drive shaft 22 also passes through a bore 28 of a valve plate 30 joined to the port end cover 26 and defining a cover plate assembly. A suitable bearing 32 is disposed between the walls of the counterbore 24 and the bore 28, and the opposite end of the drive shaft 22. The drive shaft 22 is rotatable about a longitudinal drive shaft axis A passing through the housing 12.

Figure 4:
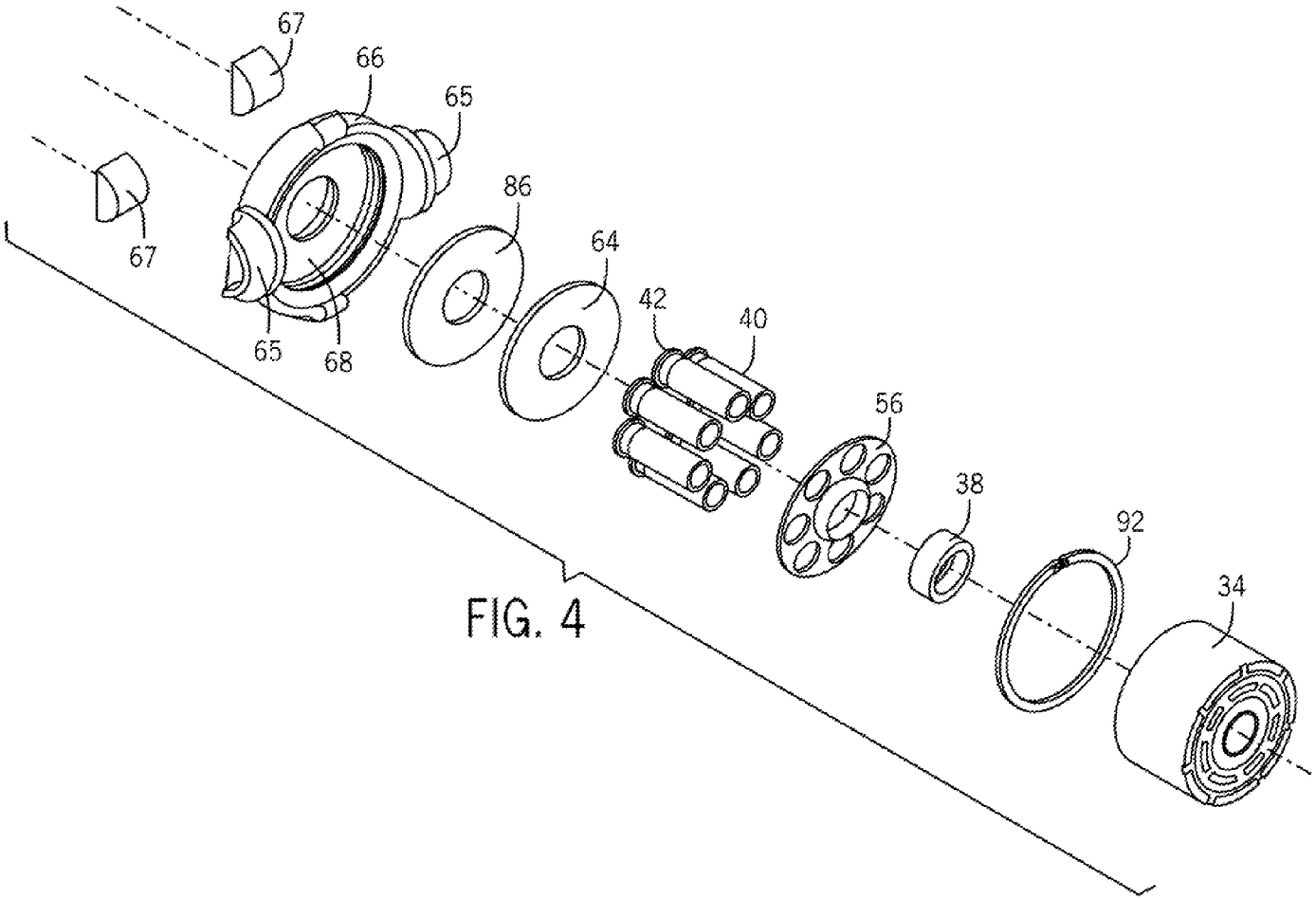
FIG. 4 is an exploded view of the components of the holddown system shown in FIGS. 1 and 2.

A rotor group or assembly including a generally cylindrical rotor 34 is mounted for rotation on the drive shaft 22 by a splined connection 36. The rotor 34 has a rear end which is designed to be rotatably engaged against the valve plate 30, and a front end which is constructed to receive a spherical load transfer ring 38 connected for rotation with the drive shaft 22 by the splined connection 36. The rotor 34 includes a plurality of circumferentially spaced axially extending cylinders 40 surrounding and parallel to the drive shaft 22. An axially reciprocable piston 42 is disposed in each cylinder 40. As is well known, each cylinder 40 is in communication with a source of hydraulic fluid for enabling reciprocal sliding movement of each piston 42 therein. The outer ends of the pistons 42 are provided with horizontally disposed rivets 44 having semi-spherical rivet heads 46 about which a set of piston shoes 48 rotate. Each piston shoe 48 has a convex spherical portion 50 which slides in a concave recess 52 formed in an extreme outer end of the piston 42. Each spherical portion 50 passes through an opening 54 formed in a holddown plate 56 surrounding drive shaft 22 and having an inner portion 58 engageable with the spherical ring 38. In addition, each piston shoe 48 has a radially enlarged end 60 with a flat surface 62 that slidably engages a smooth reaction surface 63 on a rear face of a thrust plate 64 of a swashplate assembly having a swashplate 66. As is well known, the swashplate 66 is mounted for tilting movement within the housing 12, and is formed with concave side portions 65 (FIG. 4) which are tiltably engaged about trunnion blocks 67 that are fixed in the housing 12. Swashplate 66 has a dished interior surface or concavity 68 substantially across which thrust plate 64 extends. Outer portions of the swashplate 66 are provided with shoes 70 for pivotally receiving balls 72 on the end of a pressure compensating control piston 74 and a volume control piston 76 to be further described hereafter.

The holddown plate 56, the thrust plate 64 and the swashplate 66 are supported for tilting movement about an axis transverse to the longitudinal axis of the drive shaft 22 on a shaft 78. The holddown plate 56, the thrust plate 64 and the swashplate 66 are all formed with aligned central bores 80, 82, 84, respectively, for receiving the drive shaft 22. The bores 80, 82, 84 are made large enough to accommodate the full tilt angle of the swashplate 66 in operation, and to allow clearance of the largest diameter portion (i.e. splined connection 36) during assembly. The tilt position of the swashplate 66 is controlled by various combinations of the reaction forces using the control pistons 74, 76.

In accordance with the present disclosure, a holddown system includes a holddown spring 86 which is incorporated in the swashplate 66 at a front portion of the pump 10 between the swashplate 66 and the thrust plate 64. More specifically, one side of the holddown spring 86 engages a bottom wall 88 of the concavity 68 of the swashplate 66, and an opposite side of the holddown spring 86 engages a front face 90 of the thrust plate 64. During assembly, the thrust plate 64 is restrained within the concavity 68 by a retaining ring 92 located in an annular groove of the swashplate 66. After assembly, the retaining ring 92 can be removed.

The holddown spring 86 serves to continuously load and maintain the pump components together by applying a spring force from the front of the pump 10 through the thrust plate 64, the piston assemblies comprised of the pistons 42, rivets 44, heads 46 and shoes 48, and the holddown plate 56, which in turn, provides a force on the spherical load transfer ring 38 and ultimately on the rotor 34 so that it is held tightly against the valve plate 30 during rotation of the rotor assembly. The holddown spring 86 is designed to be compressed during pump assembly to provide a continuous force to ensure a sealed surface between the valve plate 30 and rotor 34, and between the slipper shoes 48, holddown plate 56 and thrust plate 64.

The holddown system of the present disclosure differs from the holddown systems of the prior art as described in the Background of the Invention by providing that the holddown spring 86 is positioned at the front rather than the rear of the pump 10, and is fixedly mounted inside the swashplate 66 so that it does not rotate with the drive shaft 22 or rotor 34 as in conventional designs. The current design eliminates imbalance and weight in the rotor assembly, and enables the reduction of a number of pump components inside the rotor 34 so it remains balanced and provides overall smoother pump operation.

Figure 3:
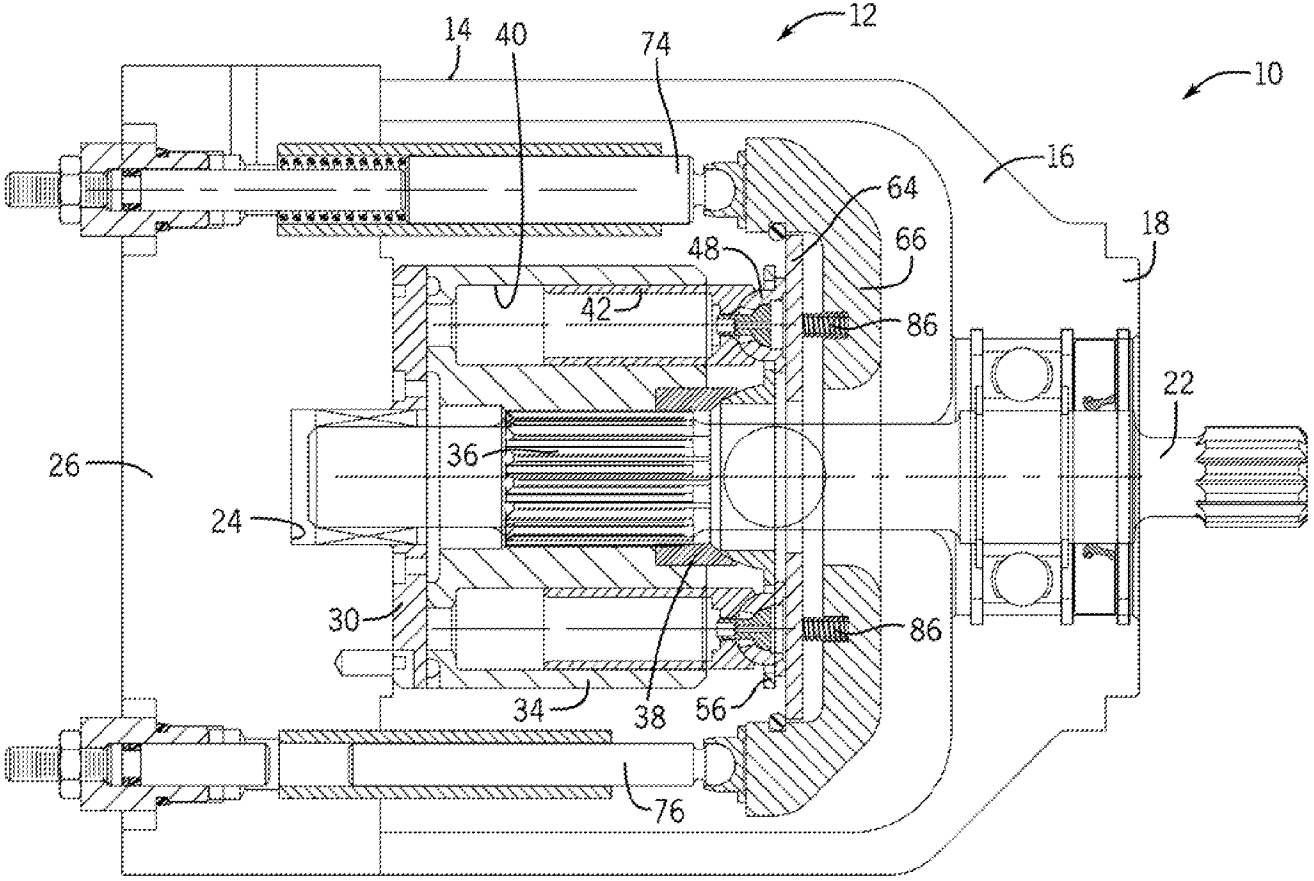
FIG. 3 is a view similar to FIG. 1, but showing an alternative type of holddown spring.

Various types and numbers of holddown springs 86 can be used behind the thrust plate in the holddown system including, but not limited to, wave springs, conical springs or compression springs, such as depicted in FIG. 3.

The basic operation of the pump 10 is summarized as follows. As the drive shaft 22 is rotated, such as by an electric motor, the rotor 34 will turn with the drive shaft 22 because of the splined connection 36 thereto. The port end cover 26 includes an inlet from a low pressure source of hydraulic fluid and an outlet from the pump for pressurized fluid, neither of which is shown in the drawings. As the shaft 22 and the rotor 34 turn, the piston ends (which rotate with the rotor 34 around the side of the pump 10 served by the fluid inlet) move axially outward against the reaction surface of the thrust plate 64 drawing hydraulic fluid into the cylinders 40. As the pistons 42 continue to rotate towards the outlet side of the pump 10, they are cammed inwardly as a result of their sliding movement along the thrust plate 64 thereby forcing hydraulic fluid from the cylinders 40. The volume of fluid drawn into and pumped out of the cylinders 40 depends on the tilted angle of the swashplate 66. The foregoing operation is common to all axial piston pumps.

Volume control is provided internally by the volume control piston 76, also known as the off stroking piston because of its tendency to bias the swashplate 66 towards a no flow or neutral position, and the opposite control or pressure compensating piston 74 which is referred to as an on stroking piston and is biased to tilt the swashplate 66 to a full or maximum flow position. The on stroking piston 74 also includes an internal bias spring 94 extending between an adjustable piston stem 96 and an end of the piston 74 to provide an inherent biasing force against the swashplate 66 in the on stroke direction. The bias spring 94 is particularly useful when the swashplate angle is small, or when the pump 10 is started and full pressure has not yet been attained to keep the swashplate 66 biased on stroke.

Figure 2:
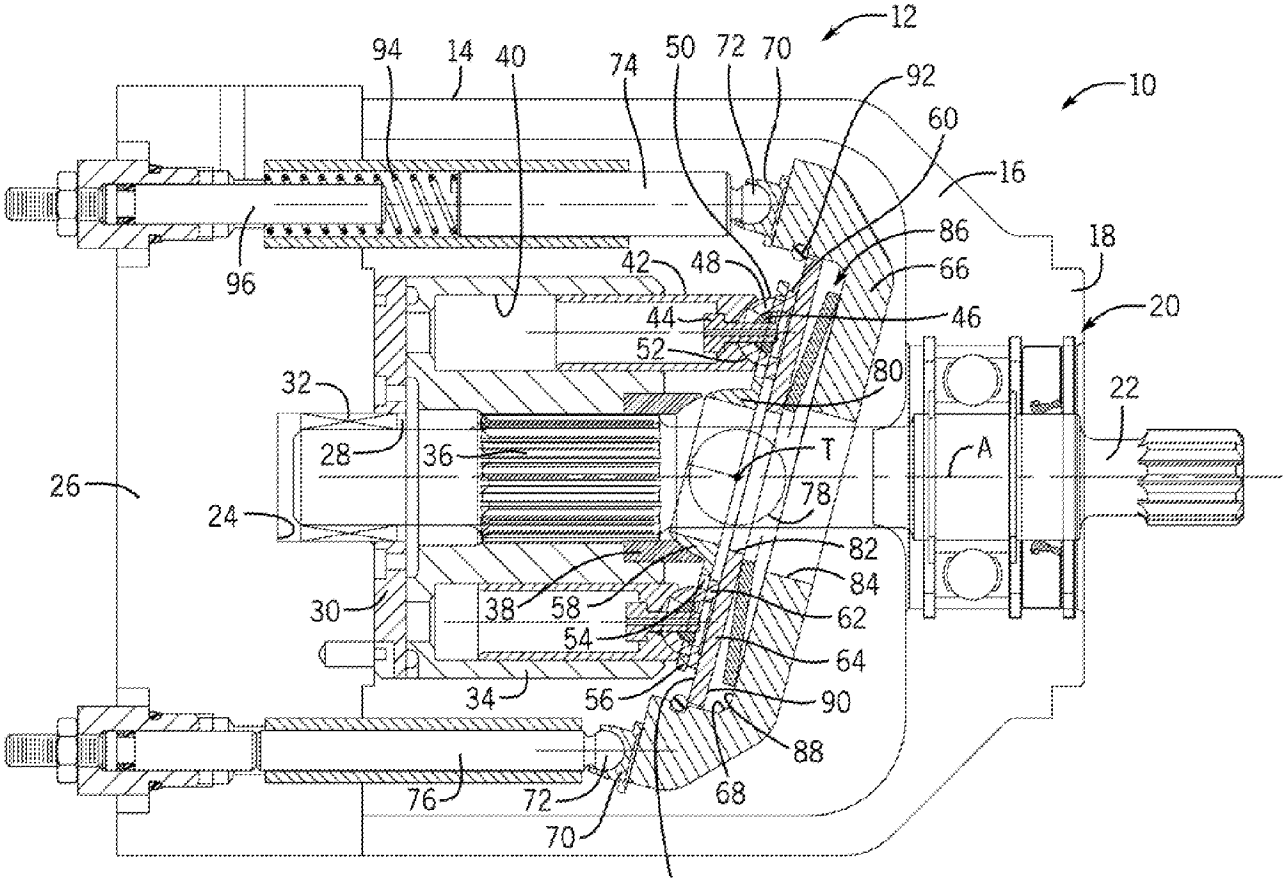
FIG. 2 is a view similar to FIG. 1, but showing the swashplate tilted to an operative flow position.

As seen in FIG. 2, when the on stroking piston 74 is applied, the holddown plate 56, the thrust plate 64, the swashplate 66 and the holddown spring 86 tilt about shaft 78, while the drive shaft 22, rotor 34, spherical load bearing ring 38 and holddown plate 56 rotate, and the ends 60 of slipper shoes 48 slide against the thrust plate 64. Holddown spring 86 continues to apply the necessary spring force to load the rotor assembly so that the rotor 34 remains balanced. Continuous loading is made possible by positioning the tilt axis T (FIG. 2) of the swashplate 66 at the rear side of the slipper shoe ends 60 so that there is no relative motion between the slipper shoes 48 and the holddown plate 56.

Figure 5:
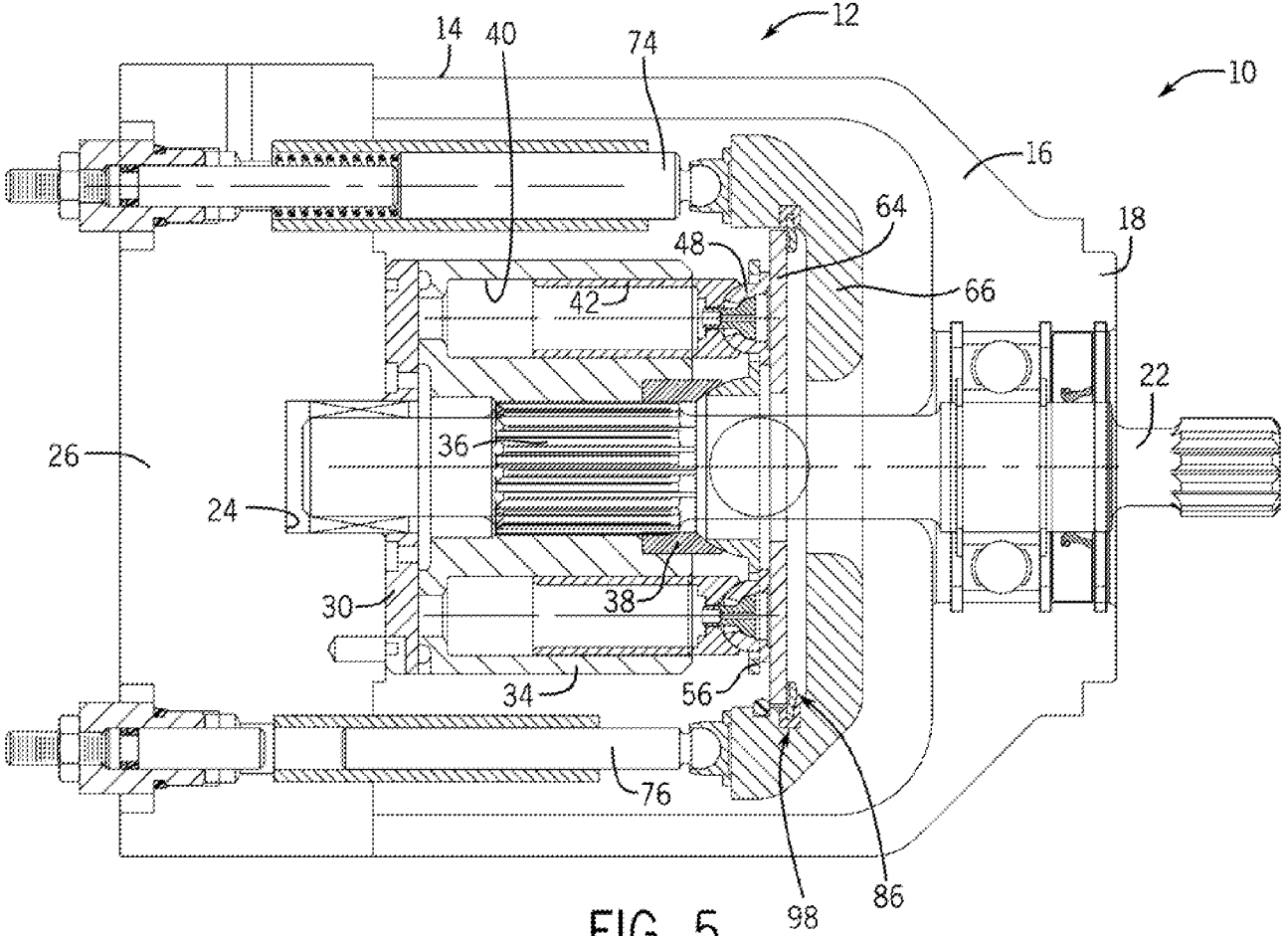
FIG. 5 is a further alternative embodiment of a holddown spring.

In a further alternative embodiment shown in FIG. 5, an annular groove 98 is formed within the swashplate 66 for receiving and retaining the holddown spring 86 in the form of a wave spring.

It should now be appreciated that the present disclosure provides a holddown system for an axial piston pump which employs a unique holddown spring 86 which does not rotate with the drive shaft 22 and is incorporated in the swashplate assembly at the front of the pump 10 to continuously maintain a proper loading of internal pump components which keeps the rotor balanced and ensures smooth, quiet pump performance.

While the invention has been described with reference to a preferred embodiment, those skilled in the art will appreciate that certain substitutions, alterations and omissions may be made without departing from the spirit thereof. Accordingly, the foregoing description is meant to be exemplary only and should not be deemed limitative on the scope of the invention set forth with the following claims.

What is claimed is:

1. An axial piston pump comprising:

a housing having an outer wall defining an interior with an end wall at one end of the housing, and a cover plate assembly at an opposite end of the housing;

a drive shaft extending through the end wall of the housing and rotatably mounted in the housing on a longitudinal drive shaft axis passing through the housing;

a rotor attached to the drive shaft for rotation therewith;

a plurality of axially disposed cylinders formed in the rotor, and provided with axially reciprocable pistons disposed in the cylinders;

a swashplate assembly surrounding the drive shaft and mounted in the housing for tilting movement on a tilt axis transverse to the drive shaft axis, a reaction surface of the swashplate assembly being engaged by outer ends of the pistons, the swashplate assembly including a swashplate having a concavity with a bottom wall, and a thrust plate extending across the concavity and forming the reaction surface;

a control arrangement for tilting the swashplate assembly on the tilt axis to maintain the reaction surface angularly disposed with respect to the drive shaft axis; and a holddown spring arrangement incorporated within the swashplate assembly between the bottom wall of the concavity of the swashplate and the thrust plate, and positioned outside the rotor such that the holddown spring arrangement tilts with the swashplate assembly and does not rotate with the drive shaft, the holddown spring arrangement being configured to apply by itself a continuous force holding the outer ends of the pistons against the thrust plate and simultaneously holding the rotor against the cover plate assembly, wherein the holddown spring arrangement is configured to space the thrust plate rearwardly away from the bottom wall of the concavity of the swashplate.

2. The axial piston pump of claim 1, wherein a spherical load transfer ring is mounted for rotation with the drive shaft.

3. The axial piston pump of claim 2, wherein a holddown plate surrounds the drive shaft and is engageable with the spherical load transfer ring.

4. The axial piston pump of claim 3, wherein the pistons have piston shoes which pass through holes formed in the holddown plate.

5. The axial piston pump of claim 1, wherein the reaction surface lies on a rear face of the thrust plate.

6. The axial piston pump of claim 1, wherein the control arrangement includes a pressure compensating control piston and a volume control piston which are engaged with outer portions of the swashplate assembly.

7. The axial piston pump of claim 4, wherein the tilt axis of the swashplate assembly is positioned at a rear side of the piston shoes so that there is no relative motion between the piston shoes and the holddown plate.

8. The axial piston pump of claim 1, wherein one side of the holddown spring arrangement engages the bottom wall of the concavity, and an opposite side of the holddown spring arrangement engages a front face of the thrust plate.

9. The axial piston pump of claim 1, wherein the holddown spring arrangement includes a wave spring.

10. The axial piston pump of claim 1, wherein the holddown spring arrangement includes a conical spring.

11. The axial piston pump of claim 1, wherein the holddown spring arrangement includes a compression spring.

* * * * *